US010667971B2

(12) United States Patent
Humbert et al.

(10) Patent No.: US 10,667,971 B2
(45) Date of Patent: Jun. 2, 2020

(54) LIFT AND TILT SUPPORT APPARATUS

(71) Applicants: Todd Humbert, Chandler, AZ (US); Elizabeth Humbert, Chandler, AZ (US)

(72) Inventors: Todd Humbert, Chandler, AZ (US); Elizabeth Humbert, Chandler, AZ (US)

( * ) Notice: Subject to any disclaimer, the term of this patent is extended or adjusted under 35 U.S.C. 154(b) by 62 days.

(21) Appl. No.: 16/125,241

(22) Filed: Sep. 7, 2018

(65) Prior Publication Data

US 2019/0070052 A1 Mar. 7, 2019

Related U.S. Application Data

(60) Provisional application No. 62/555,287, filed on Sep. 7, 2017.

(51) Int. Cl.
*A61G 5/14* (2006.01)
*A61G 7/10* (2006.01)

(52) U.S. Cl.
CPC ..... *A61G 5/14* (2013.01); *A61G 7/1007* (2013.01)

(58) Field of Classification Search
CPC ..... A61G 7/005; A61G 7/10; A61G 7/109; A61G 7/1086; A61G 7/1036; A61G 7/16; A61G 7/1059; A61G 7/1007; A61G 7/018; A61G 7/1017; A61G 7/012; A61G 5/14; A61G 5/0858; A61G 5/0825; A61G 5/0841; A61G 13/04; A61G 13/06; A47K 13/10; B66F 7/0683; B66F 7/065; B66F 7/22; A61B 6/04
See application file for complete search history.

(56) References Cited

U.S. PATENT DOCUMENTS 3,379,412 A * 4/1968 Halstead ..... B66F 3/06 254/122
3,400,410 A * 9/1968 Sallinger ..... A61G 7/1059 4/564.1
3,623,617 A * 11/1971 Nemessanyi ..... B60P 1/34 414/640
4,581,778 A * 4/1986 Pontoppidan ..... A61G 7/1007 4/667
4,660,234 A * 4/1987 Schmidt ..... A61G 7/1003 4/566.1
8,052,120 B2 11/2011 Bacon
(Continued)

FOREIGN PATENT DOCUMENTS

WO WO8702974 A1 5/1987

*Primary Examiner* — Glenn F Myers
(74) *Attorney, Agent, or Firm* — Thomas W. Galvani, P.C.; Thomas W. Galvani

(57) ABSTRACT

A lift and tilt support apparatus includes opposed scissor lift assemblies. Each scissor lift assembly includes a base, an upper frame, and scissored first and second legs, each having opposed top and bottom ends. The bottom end of the first leg is pivoted to the base, and the top end of the first leg is mounted to the upper frame for reciprocal movement. The top end of the second leg is pivoted to the upper frame, and the bottom end of the second leg is mounted to the base for reciprocal movement. The top end of the first leg reciprocates in a direction skewed from the top end of the second leg. The bottom end of the second leg reciprocates in a direction skewed from the bottom end of the first leg.

18 Claims, 8 Drawing Sheets

(56) References Cited

U.S. PATENT DOCUMENTS

| | | | | |
|---|---|---|---|---|
| 2009/0278098 | A1* | 11/2009 | Bacon | B66F 7/0625 254/1 |
| 2010/0012909 | A1* | 1/2010 | Lee | B66F 7/065 254/93 R |
| 2010/0229293 | A1 | 9/2010 | Rodgers et al. | |
| 2013/0232686 | A1 | 9/2013 | Schwartz et al. | |
| 2015/0328068 | A1 | 11/2015 | Hruschka et al. | |
| 2015/0342805 | A1* | 12/2015 | Harris, Jr. | A61G 1/017 5/610 |
| 2017/0065474 | A1* | 3/2017 | Trepanier | A61G 1/02 |
| 2018/0118539 | A1* | 5/2018 | Kritzer | B66F 7/065 |

* cited by examiner

LIFT AND TILT SUPPORT APPARATUS

CROSS-REFERENCE TO RELATED APPLICATIONS

This application claims the benefit of U.S. Provisional Application No. 62/555,287, filed Sep. 7, 2017, which is hereby incorporated by reference.

FIELD OF THE INVENTION

The present invention relates generally to machinery, and more particularly to accessibility apparatuses.

BACKGROUND OF THE INVENTION

Scissor lifts are assemblies supporting and moving platforms to elevated positions within cramped lateral spaces. Scissor lifts use scissored, or criss-crossed, legs supporting the platform to raise the platform. By moving the ends of the scissored legs together, the angle of arrangement of the scissored legs changes from a more horizontal orientation to a more vertical one. This increases the aggregated height of the assembly.

Scissor lifts have drawbacks, however. They are generally used in portable applications, and so are not meant to be permanently installed in a location for a defined purpose. Further, large scissor lifts often include large and heavy support machinery, such as hydraulic or pneumatic cylinders, motors, batteries, reservoirs, and other parts necessary to lift the platform. This machinery often occupies the area under the scissored legs, leaving no room for an object which may need to be placed between the sets of legs. Further, the platforms can only be raised in a level fashion; because a person is usually atop the platform, they are not meant to tilt, rotate, move laterally, or move in any fashion other than directly up and down. An improved scissor lift assembly is needed.

SUMMARY OF THE INVENTION

A lift and tilt support apparatus includes opposed scissor lift assemblies. Each scissor lift assembly includes a base, an upper frame, and scissored first and second legs, each having opposed top and bottom ends. The bottom end of the first leg is pivoted to the base, and the top end of the first leg is mounted to the upper frame for reciprocal movement. The top end of the second leg is pivoted to the upper frame, and the bottom end of the second leg is mounted to the base for reciprocal movement. The top end of the first leg reciprocates in a direction skewed from the top end of the second leg. The bottom end of the second leg reciprocates in a direction skewed from the bottom end of the first leg.

The above provides the reader with a very brief summary of some embodiments discussed below. Simplifications and omissions are made, and the summary is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the Drawings.

DETAILED DESCRIPTION

Figure 1A:
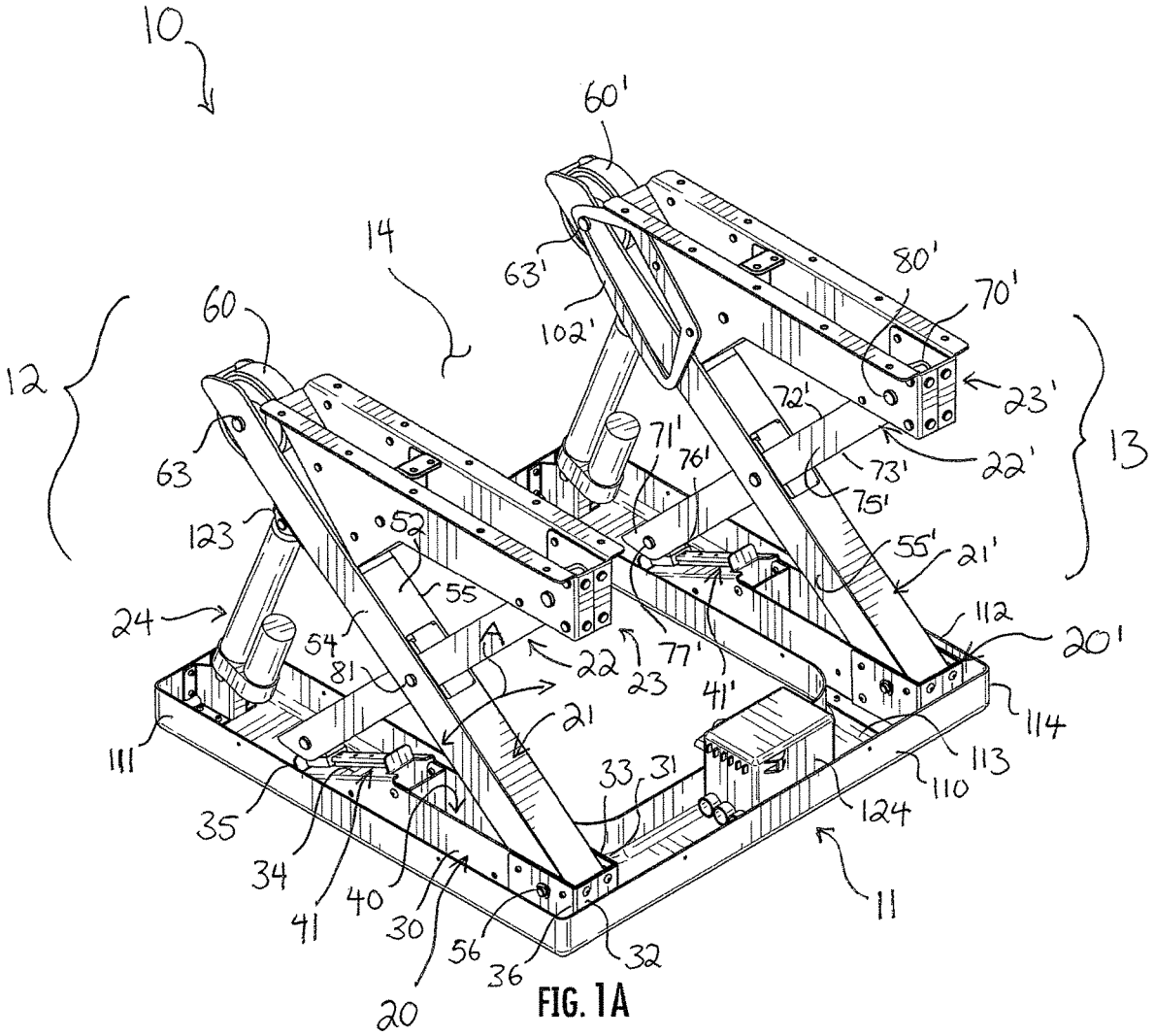
FIGS. 1A and 1B are top perspective views of a lift and tilt support apparatus in lowered and raised positions, respectively.
Figure 1B:
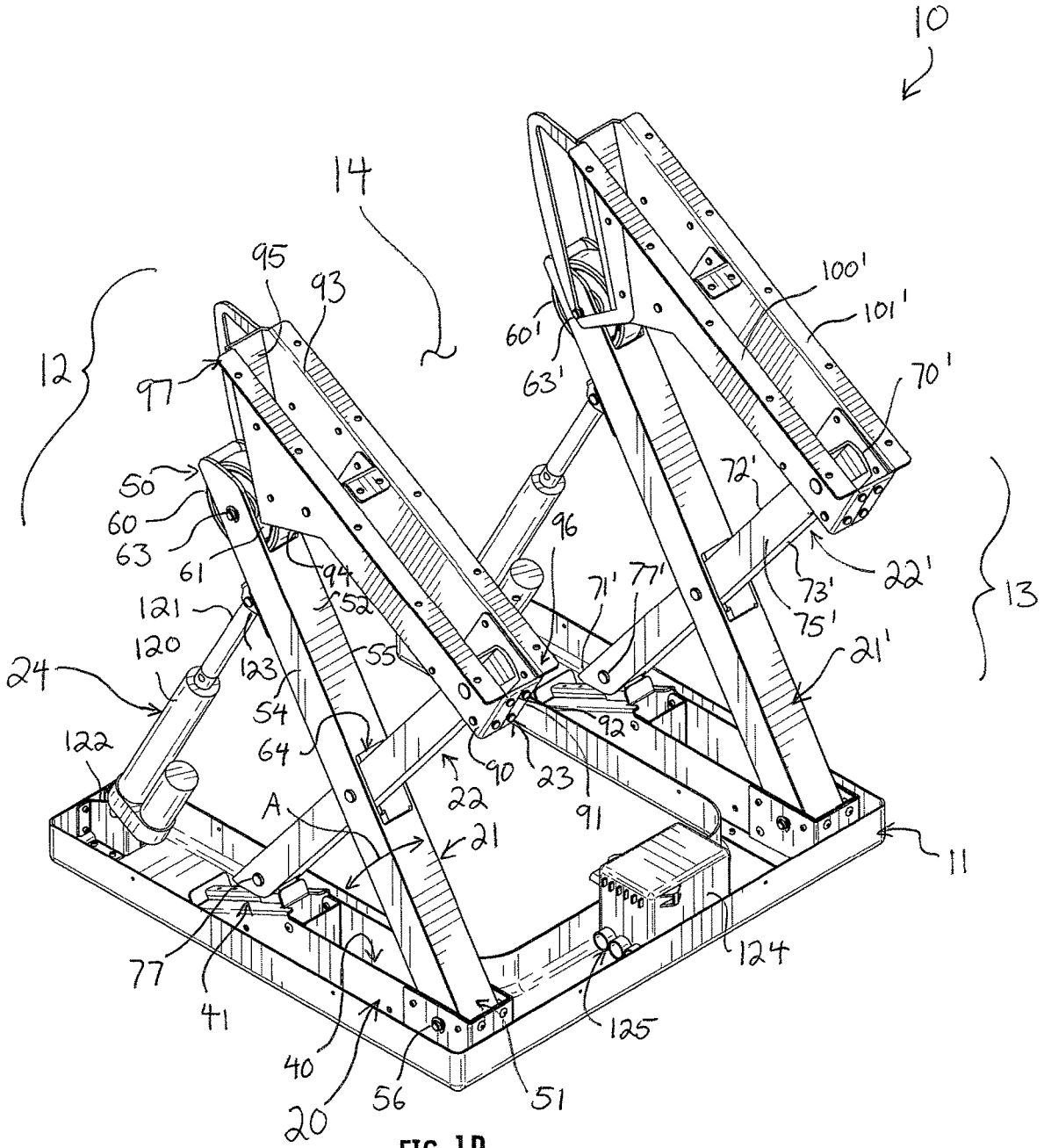

Reference now is made to the drawings, in which the same reference characters are used throughout the different figures to designate the same elements. FIGS. 1A-4B illustrate a lift and tilt support apparatus (hereinafter, the "apparatus" 10). With reference initially to FIGS. 1A and 1B, the apparatus 10 is shown in a top perspective view in a lowered condition and a raised condition, respectively. The apparatus 10 includes a U-shaped bottom plate 11 and two sets of opposed scissor lift assemblies 12 and 13 mounted on the bottom plate 11. The scissor lift assemblies 12 and 13 are structurally identical to each other, spaced apart from each other by a large open volume or void 14, and both move between lowered and raised conditions with respect to a floor 15. Because the scissor lift assemblies 12 and 13 are structurally identical to each other, reference is generally only made with respect to the scissor lift assembly 12, with the understanding that the description applies equally to the scissor lift assembly 13 unless otherwise noted. In some cases, where the drawing shows the scissor lift assembly 13 more clearly, the description may instead refer to the scissor lift assembly 13, and in such cases, it will be understood that the description applies equally to the scissor lift assembly 12. Regardless, throughout this description and the drawings, the same reference characters are used for identical structural elements and features of the scissor lift assemblies 12 and 13, but those of the scissor lift assembly 13 are marked with a prime ("′") symbol to distinguish them from those of the scissor lift assembly 12.

Still referring to FIGS. 1A and 1B, the scissor lift assembly 12 includes a base 20, an upper frame 23, and scissored first and second legs 21 and 22 extending between the base 20 and the upper frame 23. By "scissored," it is meant that the first and second legs 21 and 22 cross each other at an intermediate pivot along their lengths and thus move with respect to each other in a scissor-like fashion. A linear actuator 24 is coupled to the first leg 21 to move the first leg 21 upwardly and downwardly and thereby impart scissor movement to the scissor lift assembly 12.

The base 20 of the scissor lift assembly 12 is a strong, hard, rugged, durable base on which both the first and second legs 21 and 22 are mounted for movement. The base 20 includes opposed and parallel sidewalls 30 and 31 and an endwall 32, all rising normal from a bottom (obscured by the bottom plate 11) of the base 20 to a top 33, and a ramp 34 defining an incline from the bottom to the top 33. The base 20 has a rear end 35 and an opposed front end 36 (the directions "front" and "rear" and similar terms are herein used consistently within this directional rubric). The ramp 34 rises from the bottom at the rear end 35 of the base 20 to the top 33 at an intermediate location with respect to the rear and front ends 35 and 36. The ramp 34 is aligned with the top end of the second leg 22. The ramp 34 is straight and linear, and it defines an angle with respect to the top 33 of the base 20 of approximately twenty-five degrees but which is non-zero and is preferably between one and forty-five degrees. In other embodiments, the ramp 34 may be arcuate, rectilinear, or nonlinear to change the movement of the apparatus 10 between the lowered and raised conditions. Toward the front end 36, the top 33 is open, and a recessed pocket 40 is bound by the sidewalls 30 and 31, the endwall 32, and the front end of the ramp 34. The first leg 21 is pivoted in the pocket 40 and moves therein.

Toward the rear end 35 of the base 20, the ramp 34 is an incline up the base 20. A track 41 is fixed to the top surface of the ramp 34 and extends between the bottom and the top 33 of the base 20. The track 41 has rearward and forward stops preventing movement of a shuttle carried on the track 41 from moving off of the track 41. The track 41 has an enlarged upper portion with a narrowed lower portion which is attached along the ramp 34; the shuttle is fit over the upper portion and engaged at the narrowed lower portion so that it cannot be pulled off or drawn off of the track 41. As will be explained, the second leg 22 rides on such a shuttle and moves over the track 41.

Referring now primarily to FIG. 1B, the first leg 21 has opposed top and bottom ends 50 and 51. The first leg 21 is constructed from a square bar or strut extending between the top and bottom ends 50 and 51, preferably made from a rigid, strong, and durable material or combination of materials such as metal, carbon fiber, or high-density plastic. It has an upper side 52, an opposed lower side 53 (visible only in FIGS. 2A and 2B), and opposed lateral sides 54 and 55. The upper and lower sides 52 and 53 are parallel to each other and perpedincular to the lateral sides 54 and 55, which are parallel to each other. Each of the sides 52-55 is flat and smooth, extending linearly between the opposed top and bottom ends 50 and 51.

The bottom end 51 of the first leg 21 is pivoted to the base 20. A pin 56 extends through the sidewalls 30 and 31 of the base 20 and through the bottom end 51 of the first leg 21 to pin the first leg 21 to move in pivotal movement with respect to the base 20. A hole, though not seen in FIG. 1B, is formed through the bottom end 51 to receive the pin 56 therethrough. The hole presents a plain bearing surface for the pin 56; in other embodiments, the hole is larger and fit with a rolling or ball bearing to reduce the friction acting against relative rotation of the base 20, the bottom end 51, and the pin 56. The pin 56 is captured in the base 20, preferably with cotter pins, or other similar capture means, on the outside of the sidewalls 30 and 31. The pin 56 allows the bottom end 51 of the first leg 21 to pivot along the double-arrowed arcuate line A-A in FIGS. 1A and 1B. The hole is formed through the lateral sides 54 and 55 approximately midway between the upper and lower sides 52 and 53 of the first leg 21, such that the pin 56 extends through the first leg approximately midway between the upper and lower sides 52 and 53. When the first leg 21 pivots, it rotates around the pin 56 in the pocket 40, moving slightly in and out of the pocket 40 in a rocking motion while doing so.

Figure 2A:
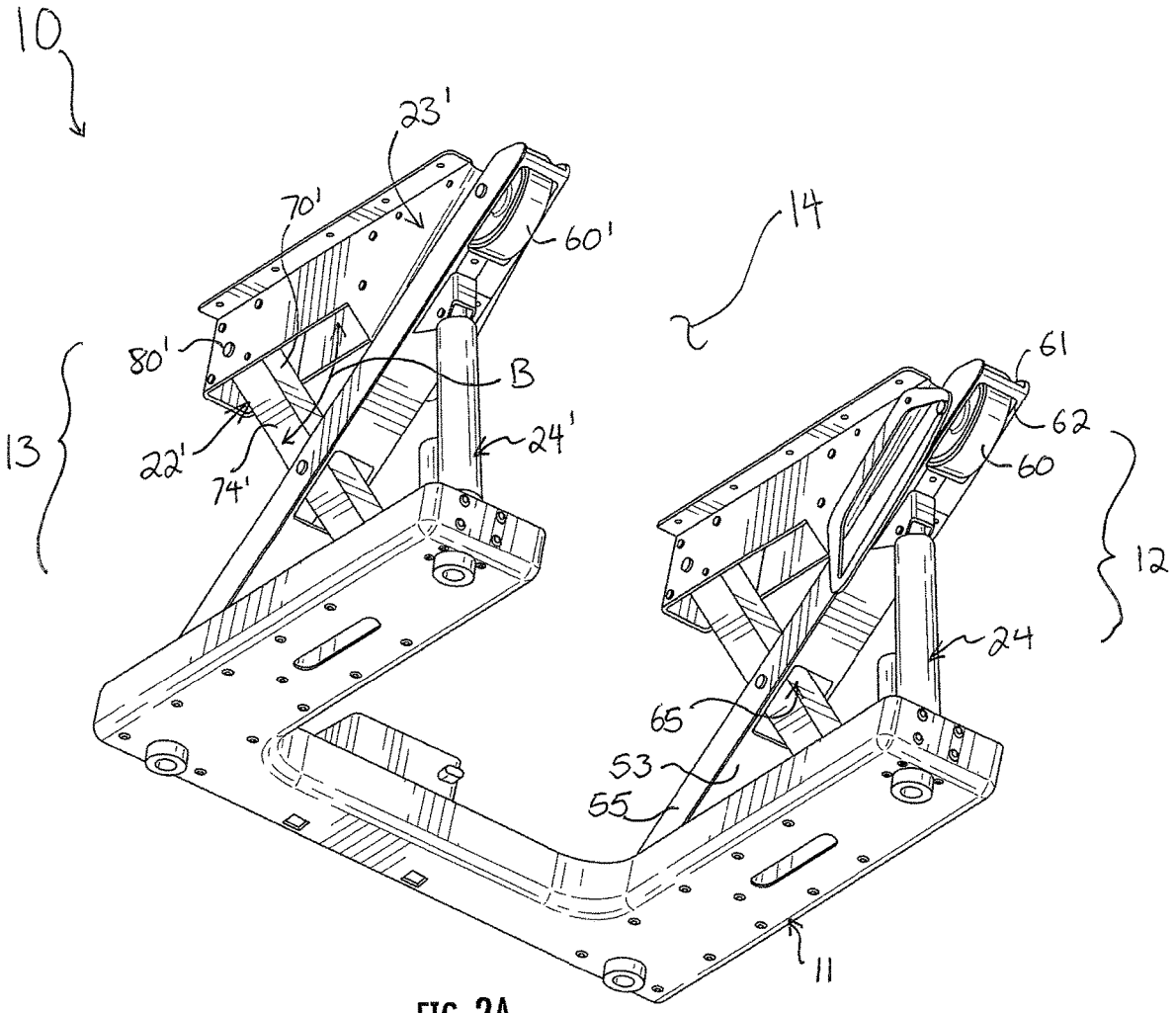
FIGS. 2A and 2B are bottom perspective views of the lift and tilt support apparatus of FIG. 1A in the lowered and raised positions, respectively.

The top end 50 of the first leg 21 rolls along the upper frame 23 with a wheel 60 carried in the top end 50. Referring primarily to FIGS. 1B and 2A, cutouts 61 and 62 are formed in the upper and lower sides 52 and 53 of the first leg 21 proximate to the top end 50 to accommodate the large diameter of the wheel 60, which is approximately two to three times larger than the first leg 21 is between its upper and lower sides 52 and 53. The wheel 60 is mounted for rotation on a pin or an axle 63 that extends entirely through the width of the wheel 60 at its center and then also through the lateral sides 54 and 55 of the first leg 21. That axle 63 is mounted approximately midway between the upper and lower sides 52 and 53 of the first leg 21. The wheel 60 has a somewhat soft and tacky tread surface to roll smoothly along the upper frame 23 with sufficient friction to eliminate slipping. Because the ramp on the upper frame 23 along which the wheel 60 rolls is angled (as is explained below), the top end 50 of the first leg 21 reciprocates in a direction which is misaligned with, or skewed from, or non-colinear with the top end of the second leg 22. In other words, the top end 50 of the first leg 21 does not reciprocate directly back and forth toward and away from the top end of the second leg 22; it instead reciprocates in a different direction, a direction which is misaligned with, skewed from, or non-colinear to the top end of the second leg 22.

Disposed between the top and bottom ends 50 and 51 of the first leg 21 are two notches 64 and 65 in the upper and lower sides and 53, respectively. The second leg 22 extends through these notches 64 and 65 and is pivoted to the first leg 21 on a pin 81 between them so that the first and second legs 21 and 22 can move with respect to each other in a scissor-like fashion while also intersecting and overlying each other.

Referring now primarily to FIGS. 1A and 1B, and to the scissor lift assembly 13 for clarity of the illustration, the second leg 22' has opposed top and bottom ends 70' and 71'. The second leg 22' is constructed from a square bar or strut extending between the top and bottom ends 70' and 71', preferably made from a rigid, strong, and durable material or combination of materials such as metal, carbon fiber, or high-density plastic. It has an upper side 72', an opposed lower side 73', and opposed lateral sides 74' (visible only in FIGS. 2A and 2B) and 75'. The upper and lower sides 72' and 73' are parallel to each other and perpedincular to the lateral sides 74' and 75', which are parallel to each other. Each of the sides 72'-75' is flat and smooth, extending linearly between the opposed top and bottom ends 70' and 71'.

The bottom end 71' of the second leg 22' slides along the base 20' with a shuttle 76' carried on the track 41'. The shuttle 76' is a small body having an upper portion and a lower portion. The lower portion of the shuttle 76' has inwardly extending flanges, wheels, or bearings which capture the narrowed lower portion of the track 41' to prevent the bottom end 71' of the second leg 22' from lifting upward, as the force on the bottom end 71' has a vertical component when the apparatus 10 moves from the lowered condition to the raised condition. The upper portion of the shuttle 76' is simply a mount for attaching the second leg 22'. The bottom end 71' of the second leg 22' is pivoted to the upper portion of the shuttle 76'. A pin 77' extends through the lateral sides 74' and 75' of the second leg 22' and through the mount disposed between those lateral sides 74' and 75' to pin the shuttle 76' to the bottom end 71' of the second leg 22' so that the bottom end 71' of the second leg 22' reciprocates along the track 41' on the base 20. The shuttle 76' is prevented from sliding off of the track 41' by the stops fixed in place at either end of the track 41'. In some embodiments, a hole through the shuttle 76' is a plain bearing surface for the pin 77', while in other embodiments, the shuttle 76' carries a rolling or ball bearing assembly for the pin 77' to reduce the friction acting against relative rotation of the shuttle 76' and the pin 77'. The pin 77' is carried approximately midway between the upper and lower sides 72' and 73' of the second leg 22' at the bottom end 71'.

Because the ramp 34' on the base 20' along which the shuttle 76' slides is angled, the bottom end 71' of the second leg 22 reciprocates in a direction which is misaligned with, or skewed from, or non-colinear with the bottom end 51' of the first leg 21'. In other words, the bottom end 71' of the second leg 21' does not reciprocate directly back and forth toward and away from the bottom end 71' of the first leg 21'; it instead reciprocates in a different direction, a direction which is misaligned with, skewed from, or non-colinear to the bottom end 71' of the first leg 21'.

As best seen in FIG. 2A, the top end 70' of the second leg 22' is pivoted to the upper frame 23'. The bottom or underside of the upper frame 23' is open; the top end 70' passes therethrough, and a pin 80' extends through the sidewalls of the upper frame 23' and through the top end 70' of the second leg 22' to pin the second leg 22' to move in pivotal movement with respect to the upper frame 23'. A hole, though not seen in the drawings, is formed through the top end 70' to receive the pin 80' therethrough. The hole presents a plain bearing surface for the pin 80'; in other embodiments, the hole is larger and fit with a rolling or ball bearing to reduce the friction acting against relative rotation of the upper frame 23', the top end 70', and the pin 80'. The pin 80' is captured in the upper frame 23', preferably with cotter pins, or other similar capture means, on the outside of the sidewalls. The pin 80' allows the top end 70' of the second leg 22' to pivot along the double-arrowed arcuate line B-B in FIGS. 2A and 2B. The hole is formed through the lateral sides 74' and 75' approximately midway between the upper and lower sides 72' and 73' of the second leg 22', such that the pin 80' extends through the second leg 22' approximately midway between the upper and lower sides 72' and 73'.

Referring now back to the scissor lift assembly 12, an intermediate portion of the second leg 22 extends through the notches 64 and 65 in the first leg 21. As seen in FIG. 1A, the first and second legs 21 and 22 are pivoted to each other there. A pin 81 extends through both the first and second legs 21 and 22, coupling them together to move in scissor movement.

Figure 2B:
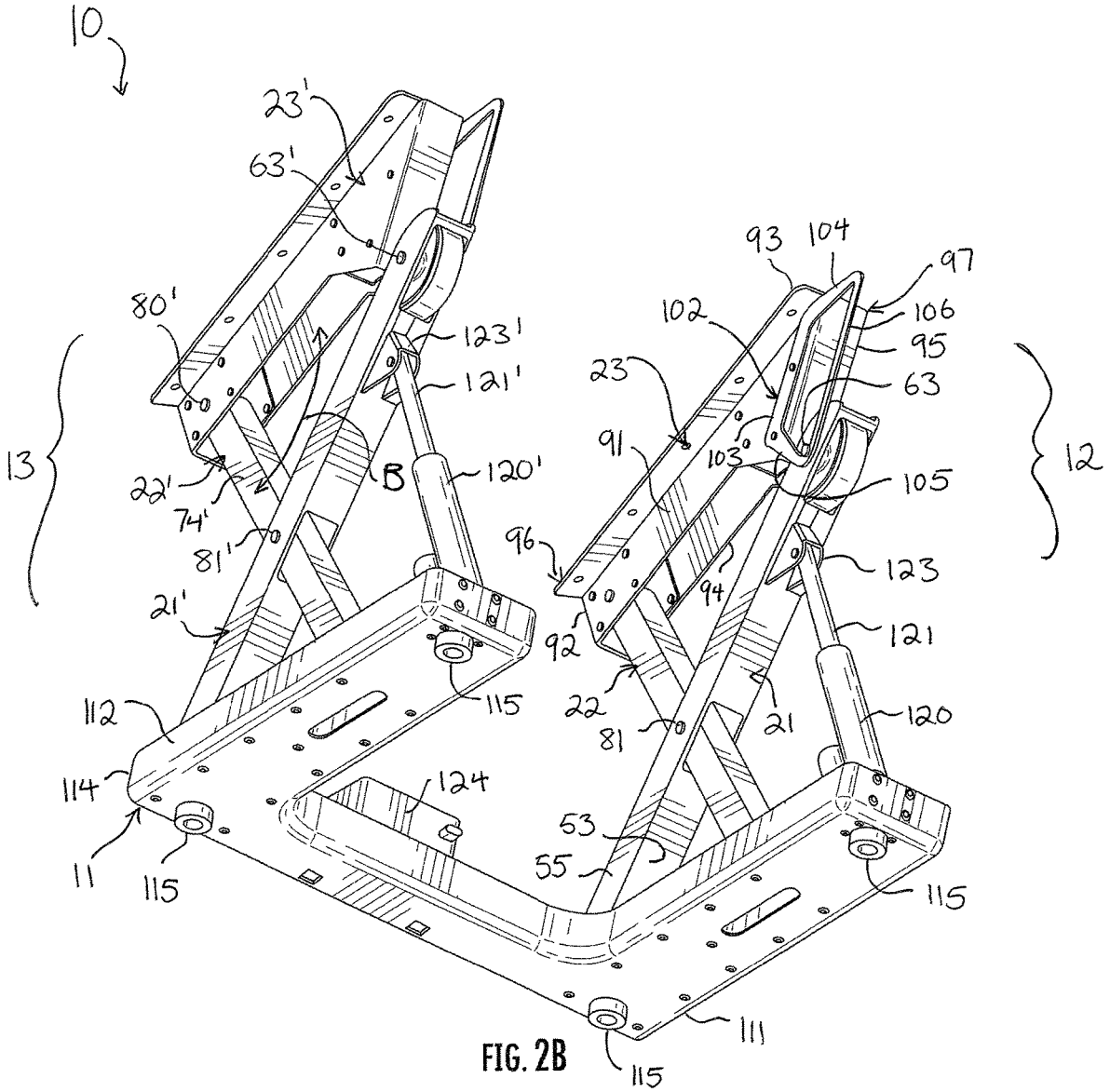

Turning now to FIGS. 1B and 2B, both the first and second legs 21 and 22 are mounted to the upper frame 23. The upper frame 23 is a strong, hard, rugged, and durable frame. The upper frame 23 includes opposed and parallel sidewalls 90 and 91 and an endwall 92, all depending from a top 93 to a bottom 94. A ramp 95 defines a decline of the upper frame 23 extending from the top 93 to the bottom 94, and forming an integral and monolithic part of the upper frame 23. The ramp 95 is roughly aligned toward the bottom end 51 of the first leg 21. The ramp 95 is straight and linear, and it defines an angle with respect to the top 93 of the base of approximately forty-five degrees but which is non-zero and is preferably between one and sixty degrees. In other embodiments, the ramp 95 may be arcuate, rectilinear, or nonlinear to change the movement of the apparatus 10 between the lowered and raised conditions. The upper frame has a front end 96 and a rear end 97, and the ramp declines from the top 93 at the rear end 97 to the bottom 94 at an intermediate location with respect to the front and rear ends 96 and 97. Toward the front end 96, and in front of the ramp 95, the bottom 94 is open; this is where the second leg 22 is coupled to the upper frame 23.

At the top 93, the sidewalls 90 and 91 turn outwardly to form flanges 100 and 101, through which a number of holes are formed. The flanges 100 and 101 extend continuously from the front end 96 to the rear end 97, and they allow a platform, seat, or other surface or object to be attached and secured to the upper frame 23.

Referring now to FIG. 2B, a guide 102 is fixed to the sidewall 91. The guide 102 is registered with the ramp 95 so that it declines from the top 93 to past the bottom 94. The guide 102 is a bracket or ring having a support portion 103, a top portion 104, a bottom portion 105, and a guide portion 106. The support portion 103 is fastened or otherwise attached to the sidewall 91, proximate to and in alignment with the ramp 95. The top and bottom portions 104 and 105 each extend outwardly from the support portion 103, the top portion 104 extending nearly parallel to the top 93 of the upper frame 23, and the bottom portion 105 extending nearly perpendicular to the upper frame 23. The guide portion 106 is a thin and straight element extending between the top and bottom portions 104 and 105. The axle 63 extending through the wheel 60 and also through the lateral sides 54 and 55 of the first leg 21 projects slightly past the lateral side 55 and terminates with a narrowed and then enlarged diameter. In other words, there is an annular channel formed in the axle 63 inset from its inside end. This channel is seated on the guide portion 106 of the guide 102, so that as the top end 50 of the first leg 21 reciprocates along the upper frame 23, the axle 63 interacts with, rides on, and is guided by the guide 102. The guide 102 prevents the wheel 60 from rolling off the ramp 95; the top and bottom portions 104 and 105 act as stops to the axle 63, thereby preventing the wheel 60 from rolling too far.

Figure 4A:
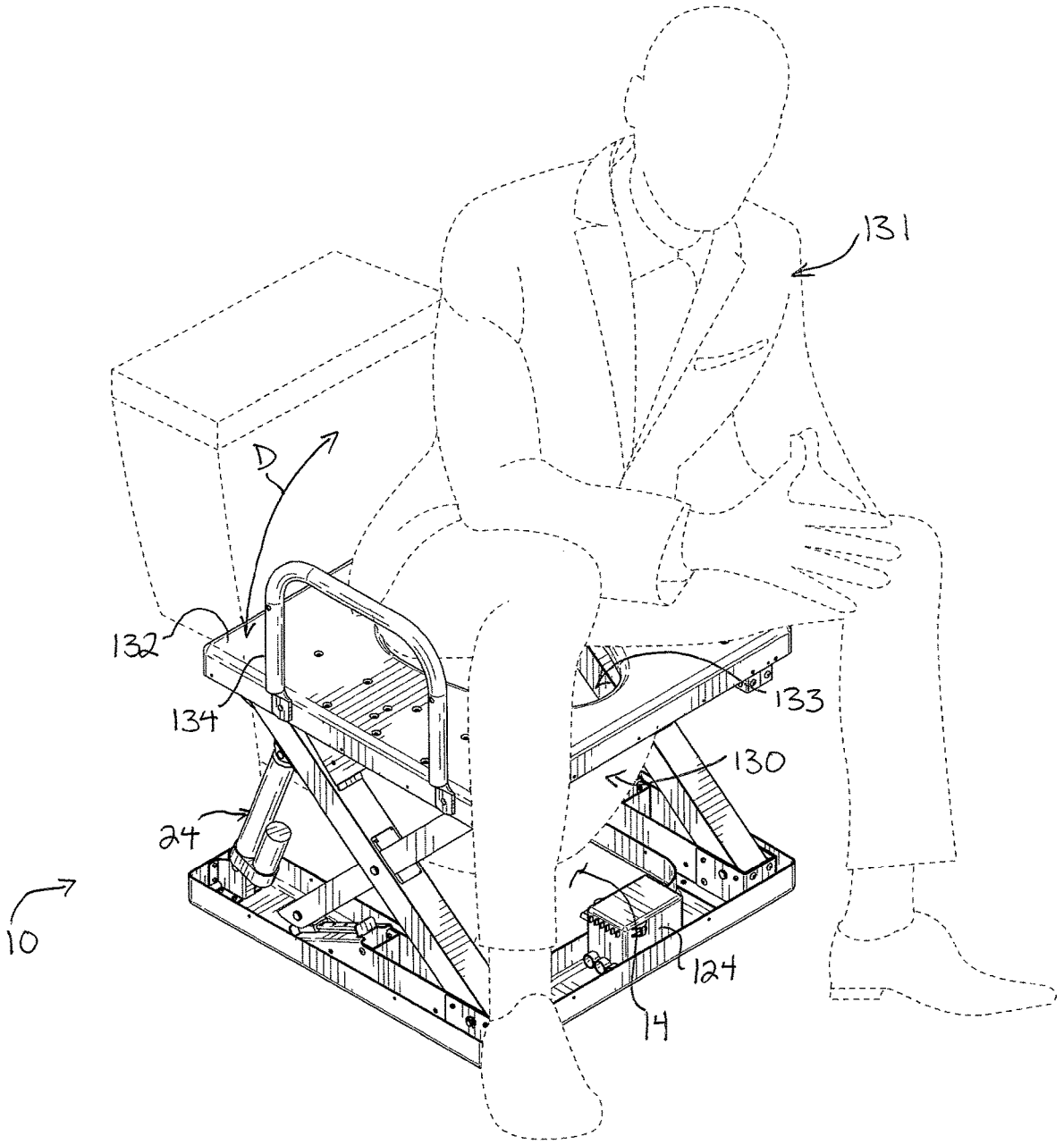
FIGS. 4A and 4B are top perspective views of an application of the lift and tilt support apparatus of FIG. 1A in the lowered and raised positions, respectively.
Figure 4B:
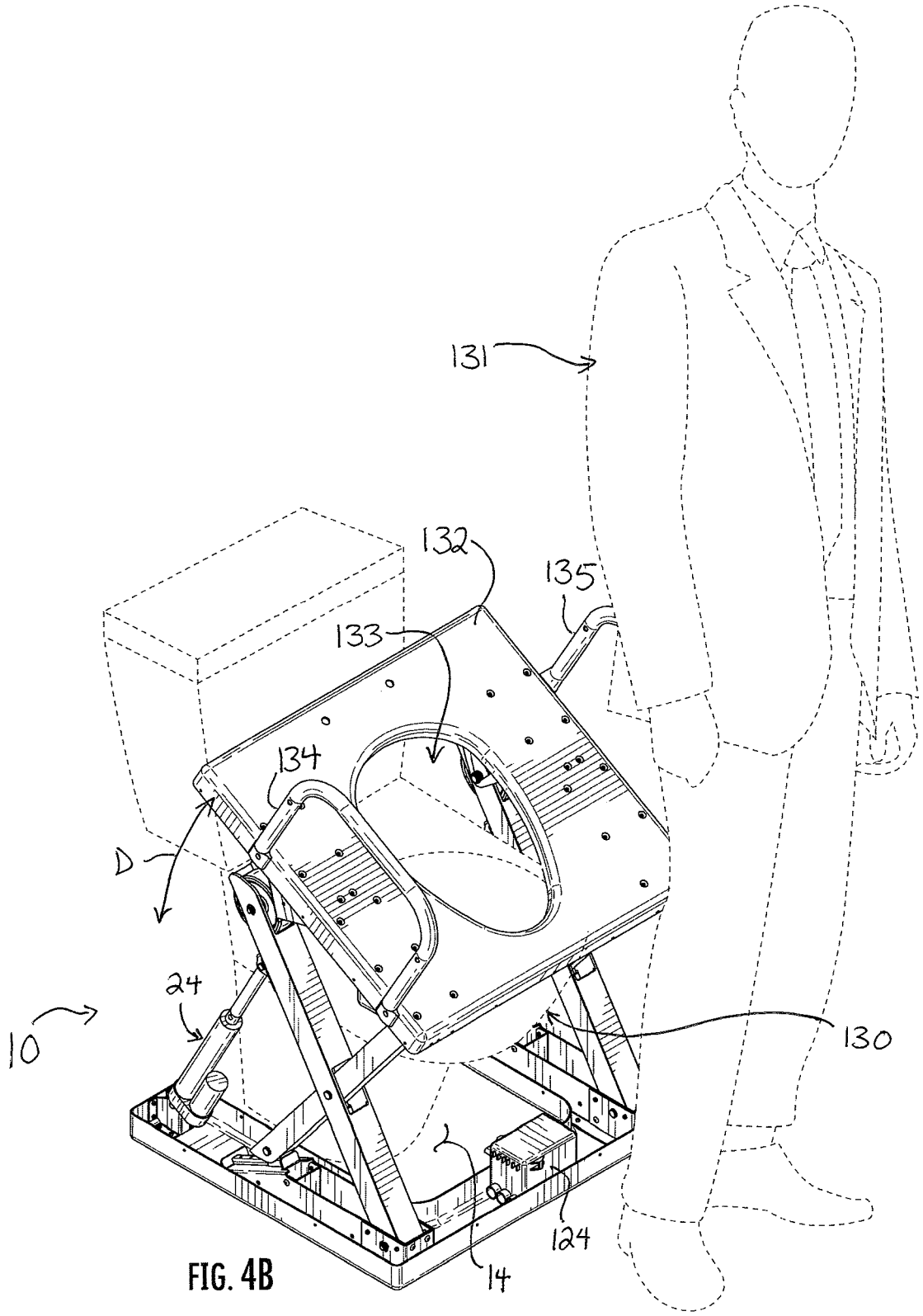

With reference to FIGS. 1A and 2B, the scissor lift assemblies 12 and 13 are mounted on the bottom plate 11, which sets and maintains their orientation with respect to each other. The bottom plate 11 has a front 110 and two opposed sides 111 and 112 extending rearward from the front 110. The bottom plate 11 is a strong, hard, rigid, rugged, and durable base constructed from a material or combination of materials such as metal, carbon fiber, or high-density plastic. The bottom plate 11 has a bottom 113 and an upstanding lip sidewall 114 projecting upward from the bottom 113 and extending continuously around the bottom plate 11. The bases 20 and 20' and the linear actuators 24 and 24' are mounted to the bottom and the sidewall 114 to secure them and to fix them in place. The bases 20 and 20' are secured in a laterally spaced-apart manner so that the scissor lift assemblies 12 and 13 are spaced apart from each other with the void 14 therebetween. When the scissor lift assemblies 12 and 13 move, they move along the void 14 and not into the void 14. Indeed, nothing moves into the void 14, and thus the void 14 is available, as is seen in FIGS. 4A and 4B, to receive an appliance or other object. Feet 115 (shown in FIG. 2B) on the underside of the bottom 113 slightly elevate the bottom plate 11 off the floor 15 and provide anti-slip traction with the floor 15.

The linear actuator 24 shown in the drawings is a hydraulic cylinder but is exemplary of other linear actuators, such as pneumatic cylinders, telescoping electric motors, etc. It includes a housing 120 and a telescoping rod 121 carried in the housing 120, the linear actuator 14 being pivotally mounted on a bracket 122. The bracket 122 is secured to the sidewall 114 and bottom 113 of the bottom plate 11 at the rear end of the side 111. The bracket 122 has a pivot point near its top to which the housing 120 is attached with a pin. The housing 120 is a hydraulic housing and carries the rod 121 for movement between a retracted position (shown in FIG. 1A) and an extended position (shown in FIG. 1B). A distal end of the rod 121 is pivoted with a pin on a bracket 123 secured to the lower side 53 of the first leg 21. The bracket 123 is located just under, or just in front of, the cutout 62 for the wheel 60 at the top end 50 of the first leg 21.

The linear actuator 24 is actuated by a hydraulic pump 124. The pump 124 has inlet and outlet ports 125 which are coupled to the linear actuator 24 by hoses. The hoses supply hydraulic fluid to the linear actuator 24 from the pump 124 to move the rod 121 to the extended position thereof, and return hydraulic fluid from the linear actuator 24 to the pump 124 to move the rod 121 to the retracted position thereof. The hoses are not shown in these drawings for clarity of the illustration and because one having ordinary skill in the art would understand their construction and operation. Although the above description identifies the linear actuator 24 as a hydraulic cylinder, in other embodiments it may be a pneumatic cylinder and the pump 124 an air pump, or a screw drive and a power transformer, etc.

Figure 3A:
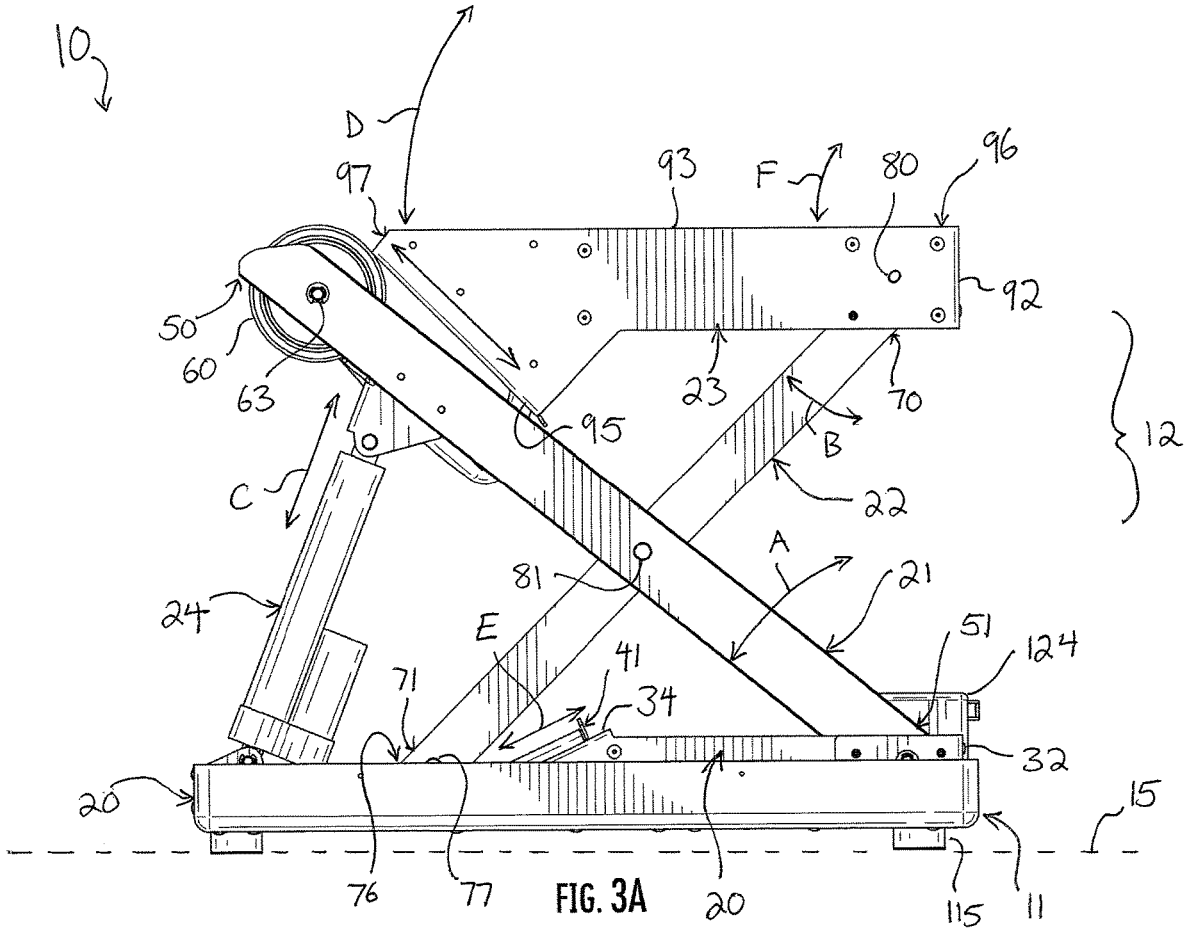
FIGS. 3A and 3B are side elevation views of the lift and tilt support apparatus of FIG. 1A in the lowered and raised positions, respectively.
Figure 3B:
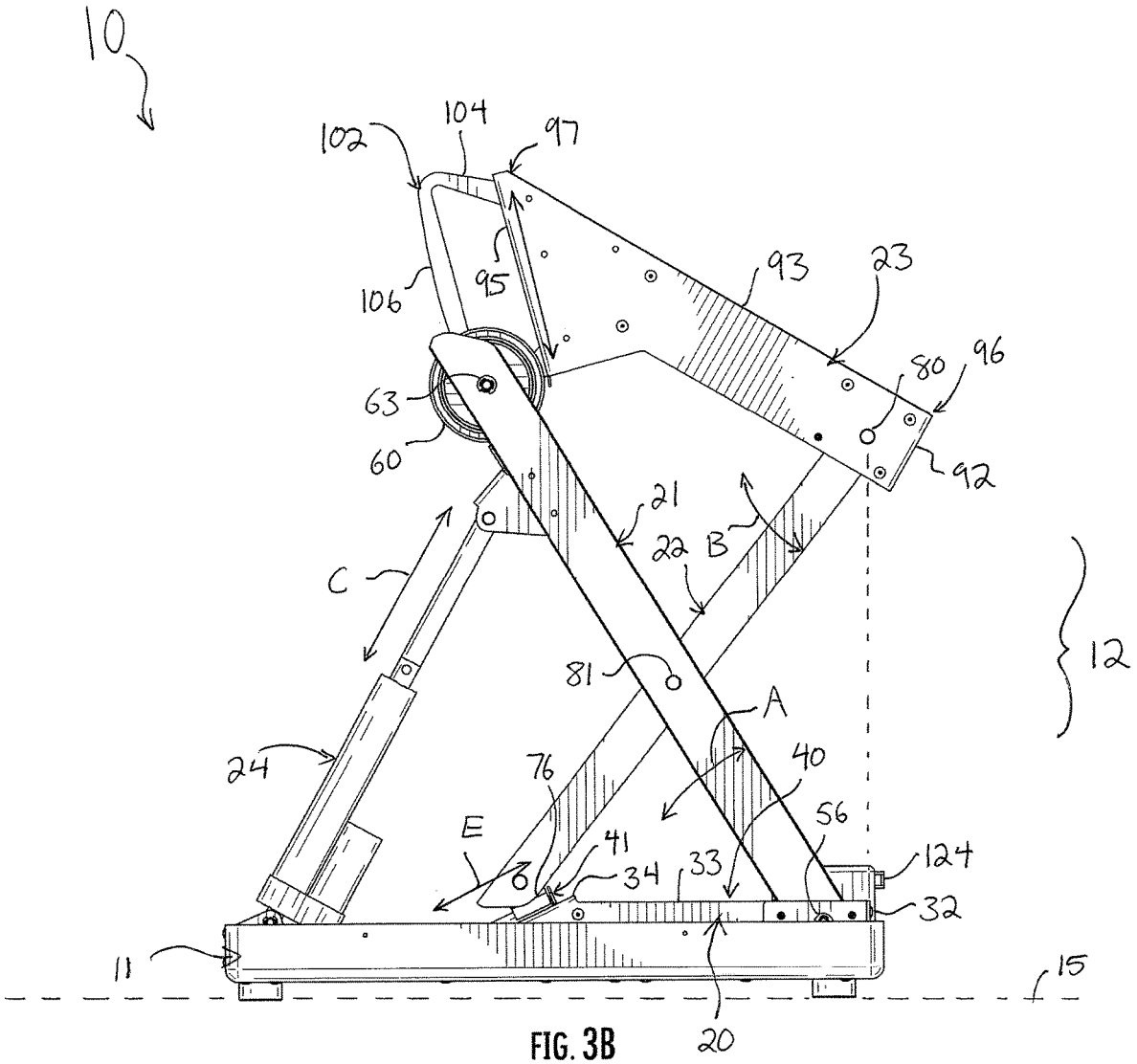

In operation, the apparatus 10 is suitable to support, lift, and tilt a surface or an object. Referring now to FIGS. 3A and 3B, which are side elevation views showing the apparatus 10 in the lowered and raised conditions, respectively, the movement of all of the constituent structural elements and features of the apparatus 10 can be seen. The lowered condition is shown in FIG. 3A. It is defined by the rod 121 of the linear actuator 24 being in the retracted position, and each of the scissor lift assemblies 12 and 13 in the lowered condition. Further, the top 93 is parallel with the floor 15 and the base 20. The top ends 50 and 70 of the first and second legs 21 and 22, respectively, are level with each other, and a line drawn between them (and specifically between the axle 63 and pin 80) would be parallel to the floor 15. Similarly, the bottom ends 51 and 71 of the first and second legs 21 and 22, respectively, are level with each other, and a line drawn between them (and specifically between the pins 56 and 77) would be parallel to the floor 15. Moreover, the top end 70 of the second leg 22 and the bottom end 51 of the first leg 21 are vertically aligned; a line drawn through them (or more specifically the pins 80 and 56) would be normal to the floor 15). Further, the endwalls 32 and 92 of the base 20 and upper frame 23, respectively, are also parallel and vertically aligned with each other. The top end 50 of the first leg 21 sits further to the rear than the bottom end 71 of the second leg 22. The wheel 60 and the shuttle 76 are both positioned in retracted states: the wheel 60 is positioned on the ramp 95 proximate the rear end 97, and the shuttle 76 is proximate to the bottom of the base 20, at the rear end of the track 41. The axle 63 of the wheel 60 is against the top portion 104 of the guide 102. Lastly, the first leg 21 and the second leg 22 are each "down," or closer to the base 20 than when they are in the raised condition of the apparatus 10. The above arrangements define characteristics of the lowered condition of the apparatus 10 and of both scissor lift assemblies 12 and 13.

Actuation of the linear actuator 24 moves the apparatus 10 from the lowered condition of FIG. 3A to the raised condition of FIG. 3B. The pump 124 supplies hydraulic fluid to the linear actuator 24, thereby causing the rod 121 to extend along the line C. This causes the first leg 21 to lift, which causes the wheel 60 to roll forwardly along the ramp 95. Again, the ramp 95 is not directed horizontally or level toward the top end 70 of the second leg 22, but is instead skewed therefrom, and so the top end 50 of the first leg 21 rolls along its path of reciprocation toward a location below the top end 70 of the second leg 22. The ramp 95 is aligned toward the bottom end 51 of the first leg 21, and so the wheel 60 rolls in that direction. The top end 50 of the first leg 21 thus reciprocates forwardly with respect to the upper frame 23 in a direction toward the bottom end 51 of the first leg 21. This causes the rear end 97 of the upper frame 23 to not only rise vertically but to pitch forward, as indicated by the arrowed line D in FIG. 3A.

Because the first and second legs 21 and 22 are pivoted to each other at the pin 81, upward movement of the first leg 21 imparts upward movement of the second leg 22. The second leg 22, with its bottom end 71 coupled to the track 41 with the shuttle 76, moves upward and forward. The shuttle 76 rides up the track 41 on the ramp 34. Again, the ramp 34 is not directed horizontally or level toward the bottom end 51 of the first leg 21 but is instead skewed therefrom, and so the bottom end 71 of the second leg 22 moves along its path of reciprocation toward a location above the bottom end 51 of the first leg 21. The ramp 34 is aligned with or directed roughly toward the top end 70 of the second leg 22, and so the bottom end 71 of the second leg 22 moves in that direction as it slides forwardly along the track 41 along the line E. This causes the front end 96 to not only rise vertically but to pitch forward, as indicated by the arrowed line F in FIG. 3A.

The linear actuator 24 is actuated in this manner until the axle 63 of the wheel 60 is stopped by the bottom portion 105 of the guide 102 on the upper frame 23. Preferably, this corresponds to the full stroke length of the rod 121, so that the rod 121 reaches its full extended position at the same moment that the axle 63 contacts the bottom portion 105 of the guide 102. When the linear actuator 24 is fully extended and the axle 63 is against the bottom portion 105 of the guide 102, the apparatus 10 and the scissor lift assemblies 12 and 13 are all in their raised conditions.

The raised condition of the apparatus 10 is shown in FIG. 3B. As mentioned, it is defined by the rod 121 of the linear actuator 24 being in the extended position, and each of the scissor lift assembles 12 and 13 in the raised condition. Further, the top 93 is angled with respect to the floor 15 and the base 20; the front end 96 is lower than rear end. The top ends 50 and 70 of the first and second legs 21 and 22, respectively, are no longer level with each other, and a line drawn between them (and specifically between the axle 63 and the pin 80) would be oriented at an angle of approximately 7 degrees to the floor 15 and the base 20. The bottom ends 51 and 71 of the first and second legs 21 and 22, respectively, continue to be level with each other, and a line drawn between them (and specifically between the pins 56 and 77) would continue to be parallel to the floor 15 and the base 20. Moreover, the top end 70 of the second leg 22 and the bottom end 51 of the first leg 21 are no longer vertically aligned; a line drawn through them (or more specifically the pins 80 and 56) would be oblique with respect to the floor 15 and the base 20) because the top end 70 of the second leg 22 is in front of the bottom end 51 of the first leg 21. Indeed, FIG. 3B shows a broken line extending directly down (normal to the floor 15 and base 20 from the pin 80 at the front end 96 of the upper frame 23; that broken line is just in front of the endwall 32 of the base 20. Further still, the endwalls 32 and 92 of the base 20 and upper frame 23, respectively, are no longer parallel or vertically aligned with each other; the endwall 92 is in front of the endwall 32, and the endwall 92 is oriented obliquely with respect to the floor 15. The top end 50 of the first leg 21 still sits further to the rear than the bottom end 71 of the second leg 22, but the horizontal distance between the top end 50 of the first leg 21 and the bottom end 71 of the second leg 22 is smaller than in the lowered condition. The wheel 60 and the shuttle 76 are both now positioned in advanced locations: the wheel 60 is positioned on the ramp 95 away from the rear end 97, and the shuttle 76 is proximate to the top 33 of the base 20, at the front end of the track 41 by the pocket 40. The axle 63 of the wheel 60 is against the bottom portion 105 of the guide 102. Lastly, the first leg 21 and the second leg 22 are each "up," or further from the base 20 than when they were in the lowered condition of the apparatus 10. The above arrangements define characteristics of the raised condition of the apparatus 10 and of both scissor lift assemblies 12 and 13.

To return the apparatus 10 and the scissor lift assemblies 12 and 13 to the lowered condition, the process is simply reversed. The pump 124 draws hydraulic fluid from the linear actuator 24, and the rod 121 moves to the retracted position thereof. This causes the first leg 21 to move downward and backward, which imparts downward movement of the second leg 22. The wheel 60 rolls back to its initial position along the ramp 95, and the shuttle 76 slides back down the track 41. The apparatus 10 is returned to the lower condition.

The apparatus 10 is useful in many situations. For example, a table surface may be mounted atop the upper frames 23 and 23' to convert the table surface into an ergonomic desk, the height and angle of which can be altered. In another example, the apparatus is mounted under a bed along the length of the bed. In such embodiments, in the lowered condition of the apparatus 10, the bed is flat. When the apparatus 10 moves to the raised condition, the bed rises and tilts forward, so that a user can slide off the end of the bed and stand up. Alternatively, the apparatus 10 is mounted under the bed perpendicular to the length of the bed. In this arrangement, when the apparatus 10 moves to the raised condition, the bed rises and tilts to the side. A user can turn to the side of the bed and stand up from the bed easily with this embodiment. The apparatus 10 is also useful with a chair. In such an embodiment, the apparatus 10 forms the support for a chair seat, wherein the seat is attached to the upper frames 23 and 23'. When a user desires to stand and walk away from the chair, the apparatus 10 is moved to the raised condition, thereby raising the seat, tilting the seat, and moving the seat slightly forward away from the bases 20 and 20', so that the user is assisted in standing and moving forward. Further still, although the apparatus 10 has been described with two scissor lift assemblies 12 and 13, in some embodiments only a single scissor lift assembly 12 may be suitable. In yet still other embodiments, the apparatus 10 may not include the shuttle 76 and the bottom end 71 of the second leg 22 is simply pivoted to the base 20, while the top end 50 of the first leg 21 is still mounted for reciprocation. In such an embodiment, the apparatus 10 would lift and tilt forward, but would not move slightly forwardly. Alternatively, in another embodiment, the apparatus 10 may not include the wheel 60 and instead the top end 50 of the first leg 21 is simply pivoted to the upper frame 23, while the bottom end 71 of the second leg 22 is still mounted for reciprocation.

Turning finally to FIGS. 4A and 4B, another embodiment is shown in detail. The void 14 between the scissor lift assemblies 12 and 13 can receive and accommodate an object or appliance such as a toilet 130. Because the scissor lift assemblies 12 and 13 are spaced apart and remain spaced apart during movement between the lowered and raised conditions, the apparatus 10 can be permanently mounted around a toilet 130 to assist users in sitting down on and getting up from the toilet 130. FIGS. 4A and 4B show a man 131 sitting on the apparatus 10. The apparatus 10 has been fitted with an oversized toilet seat 132. The toilet seat 132 is a wide, rigid planar element with a hole 133 formed therethrough corresponding to the rim of the toilet bowl. Handrails 134 and 135 are secured to the opposed sides of the seat 132 to provide the user with a gripping location when moving to sit down on the seat 132 or get up from the seat 132. The seat 132 is secured to the upper frames 23 and 23' along the flanges 100 and 101 (shown in FIG. 1B) with fasteners, so that the seat 132 does not slip or move from the apparatus 10. FIG. 4A shows the apparatus 10 in the lowered condition thereof. The man 131 sits upon the seat 132 as long as is necessary. When the man 131 desires to get up from the seat, he initiates movement of the apparatus 10. He presses an "up" button which is on the pump 124, or which may be coupled by wires or wirelessly to the pump 124, to instruct the pump 124 to begin operating and pumping hydraulic fluid to the linear actuator 24. The linear actuator 24 actuates as described above to move the apparatus 10 from the lowered condition to the raised condition. As it does, of course, the seat 132 rises and carries the man 132 both upward and forward. Further, because the seat 132 tilts, the man's center of gravity is positioned further forward over the seat than during the lowered condition, thereby making it easy for the man to get up from the seat 132. This movement from the lowered condition to the raised condition greatly assists the man 132 in getting up from the toilet 130. He walks away.

The apparatus 10 may be programmed to return to the lowered condition. Alternatively, and preferably, the apparatus 10 remains in the raised position until the man needs to return to the toilet 130, at which point he guides himself backward onto the seat 132 and then initiates movement of the linear actuator 24 from the extended position to the retracted position. The apparatus 10 moves to the lowered position, and the man 131 is disposed directly over the toilet 130.

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof. To the extent that modifications do not depart from the spirit of the invention, they are intended to be included within the scope thereof.

The invention claimed is:

1. A lift and tilt support apparatus, comprising:

opposed scissor lift assemblies, each comprising:

a base and an upper frame;

scissored first and second legs, each having opposed top and bottom ends;

the bottom end of the first leg pivots, and the top end of the first leg reciprocates in a direction skewed from the top end of the second leg and, with respect to the upper frame, toward the bottom end of the first leg; and the top end of the second leg pivots, and the bottom end of the second leg reciprocates in a direction skewed from the bottom end of the first leg and, with respect to the base, toward the top end of the second leg.

2. The lift and tilt support apparatus of claim 1, further comprising:

the scissor lift assemblies move between a lowered condition and a raised condition;

in the lowered condition, the bottom ends of the first and second legs are level with each other, and the top ends of the first and second legs are level with each other; and in the raised condition, the top ends of the first legs are above the top ends of the second legs, and the top ends of the second legs are in front of the bottom ends of the first legs.

3. The lift and tilt support apparatus of claim 1, further comprising:

the top end of each of the first legs carries a wheel which rolls along the respective upper frame; and the bottom end of each of the second legs has a shuttle which slides along a track on the respective base.

4. The lift and tilt apparatus of claim 1, further comprising:

an incline on each of the bases;

a decline on each of the upper frames;

the top end of each of the first legs rolls along the respective decline; and the bottom end of each of the second legs slides along the respective incline.

5. The lift and tilt apparatus of claim 1, further comprising a guide on each of the upper frames which limits reciprocal movement of the top end of the respective first leg.

6. The lift and tilt apparatus of claim 1, further comprising a void between the scissor lift assemblies for receiving an appliance.

7. A lift and tilt support apparatus, comprising:

a base and an upper frame;

a scissor lift assembly including scissored first and second legs, each having opposed top and bottom ends;

the first leg is pivoted at the bottom end thereof and is mounted for reciprocal movement at the top end thereof;

the second leg is pivoted at the top end thereof and is mounted for reciprocal movement at the bottom end thereof;

the top end of the first leg reciprocates in a direction skewed from the top end of the second leg and, with respect to the upper frame, toward the bottom end of the first leg; and the bottom end of the second leg reciprocates in a direction skewed from the bottom end of the first leg and, with respect to the base, toward the top end of the second leg.

8. The lift and tilt support apparatus of claim 7, further comprising:

the scissor lift assembly moves between a lowered condition and a raised condition;

in the lowered condition, the bottom ends of the first and second legs are level with each other, and the top ends of the first and second legs are level with each other; and in the raised condition, the top end of the first leg is above the top end of the second leg, and the top end of the second leg is in front of the bottom end of the first leg.

9. The lift and tilt support apparatus of claim 7, further comprising:

the top end of the first leg carries a wheel which rolls along the upper frame; and the bottom end of the second leg has a shuttle which slides along a track on the base.

10. The lift and tilt apparatus of claim 7, further comprising:

an incline on the base and a decline on the upper frame;

the top end of the first leg rolls along the decline; and the bottom end of the second leg slides along the incline.

11. The lift and tilt apparatus of claim 7, further comprising a guide on the upper frame which limits reciprocal movement of the top end of the first leg.

12. A lift and tilt support apparatus, comprising:

opposed scissor lift assemblies, each comprising:

a base and an upper frame;

scissored first and second legs, each having opposed top and bottom ends;

the bottom end of the first leg is pivoted to the base and the top end of the first leg is mounted to the upper frame for reciprocal movement;

the top end of the second leg is pivoted to the upper frame and the bottom end of the second leg is mounted to the base for reciprocal movement;

the top end of the first leg reciprocates in a direction skewed from the top end of the second leg and, with respect to the upper frame, toward the bottom end of the first leg; and the bottom end of the second leg reciprocates in a direction skewed from the bottom end of the first leg and, with respect to the base, toward the top end of the second leg.

13. The lift and tilt support apparatus of claim 12, wherein:

the scissor lift assemblies move between a lowered condition and a raised condition;

in the lowered condition, the bottom ends of the first and second legs are level with each other, and the top ends of the first and second legs are level with each other; and in the raised condition, the top ends of the first legs are above the top ends of the second legs, and the top ends of the second legs are in front of the bottom ends of the first legs.

14. The lift and tilt support apparatus of claim 12, further comprising:

the top ends of the first legs roll along the upper frame; and the bottom ends of the second legs slide along the base.

15. The lift and tilt support apparatus of claim 12, further comprising:

the top ends of the first legs each carry a wheel; and the bottom ends of the second legs each have shuttles which slide along tracks on the base.

16. The lift and tilt apparatus of claim 12, wherein each scissor lift assembly further comprises:

an incline on the base;

a decline on the upper frame;

the top end of the first leg rolls along the decline; and the bottom end of the second leg slides along the incline.

17. The lift and tilt apparatus of claim 12, further comprising a guide on each of the upper frames which limits reciprocal movement of the top end of the respective first leg.

18. The lift and tilt apparatus of claim 12, further comprising a void between the scissor lift assemblies for receiving an appliance.

* * * * *